US005299586A

United States Patent [19]

Jordan et al.

[11] Patent Number: 5,299,586

[45] Date of Patent: Apr. 5, 1994

[54] DISHWASHER TUB BOTTOM WALL CONSTRUCTION

[75] Inventors: Lawrence J. Jordan; Barry E. Tuller; Dennis L. Purtilo; Stephen D. Schober, all of Newton, Iowa; Lawrence L. Quayle, Harpers Ferry, W. Va.

[73] Assignee: Maytag Corporation, Newton, Iowa

[21] Appl. No.: 874,753

[22] Filed: Apr. 27, 1992

Related U.S. Application Data

[63] Continuation-in-part of Ser. No. 708,213, May 31, 1991, Pat. No. 5,118,254.

[30] Foreign Application Priority Data

Nov. 7, 1991 [CA] Canada ..... 2055110

[51] Int. Cl.[5] ..... B08B 13/00

[52] U.S. Cl. ..... 134/111; 134/155; 134/186; 134/201

[58] Field of Search ..... 134/155, 186, 201, 200, 134/570, 560, 580, 111, 100

[56] References Cited

U.S. PATENT DOCUMENTS 3,064,664 11/1962 Warhus ..... 134/111
3,179,307 4/1965 Duncan et al. ..... 134/155 X
3,415,276 12/1968 Lind et al. ..... 134/56 D
4,392,891 7/1983 Meyers ..... 134/111 X

FOREIGN PATENT DOCUMENTS 3716954 12/1988 Fed. Rep. of Germany ... 134/57 D
1403035 8/1975 United Kingdom ..... 134/57 D
2221384 2/1990 United Kingdom ..... 134/57 D

*Primary Examiner*—Frankie L. Stinson
*Attorney, Agent, or Firm*—Zarley, McKee, Thomte, Voorhees & Sease

[57] ABSTRACT

A dishwasher tub includes a bottom wall having a sump basin formed therein for containing a reservoir of washing fluid. The sump basin has an upper rim having a rear portion spaced inwardly from the rear edge of the bottom wall, opposite side portions spaced inwardly from the opposite side edges of the bottom wall, and a front portion spaced inwardly from the front edge of the bottom wall. The rim of the sump forms two spaced apart leg portions of the basin which extend forwardly into close proximity to the front spaced apart corners of the front wall of the tub. In addition to the sump basin, the bottom wall includes front, rear, and opposite side margins sloping upwardly from the rim of the sump basin to the rear, side, and front walls of the dishwasher tub. The resulting sump basin has a horseshoe-shaped configuration.

18 Claims, 5 Drawing Sheets

DISHWASHER TUB BOTTOM WALL CONSTRUCTION

This is a continuation-in-part of copending application Ser. No. 07/708,213, filed May 31, 1991, now U.S. Pat. No. 5,118,254.

BACKGROUND OF THE INVENTION

The present invention relates to a dishwasher tub bottom wall construction.

Prior art dishwashers normally include a bottom wall which functions as a reservoir for washing fluid. The washing fluid is filled into the bottom of the dishwasher to a predetermined level. A pump in the bottom of the dishwasher tub takes in the washing fluid through an inlet opening and pumps the washing fluid to various spray arms located within the dishwasher. The pump forces the washing fluid out through the spray arms where it engages and washes the dishes. The washing fluid then falls to the bottom of the dishwasher and is recirculated by the pump.

Prior art dishwashers often have a heating coil or element located within the bottom of the dishwasher. The heating coil heats the air after the dishes have been washed to help dry the dishes. In some cases the heating coil is used to increase the temperature of the washing fluid or water above the hot tap water temperature. This feature will become increasingly more important in the future in view of recent energy conservation measures which encourage homeowners to maintain tap water temperature below 140° Fahrenheit. A temperature of 140° Fahrenheit or higher is preferable for obtaining satisfactory washing results because certain fats require higher temperatures before dissolving.

Water conservation has also become an increasingly important feature for dishwashers, particularly in areas of the country which have water shortages. Not only is the conservation of water important, but because the water is heated, a reduction in the amount of water used also results in a reduction of the energy needed to heat that quantity of water.

Some dishwashers utilize a plastic molded tub formed from a plastic which for proper functioning should be kept at temperatures below 200° to 250° Fahrenheit. Most heating elements utilized in dishwashers, however, may reach surface temperatures of 800° to 1,000° Fahrenheit. It is therefore important to provide a dishwasher construction which prevents the plastic from being heated beyond the maximum temperature at which it will function properly, while at the same time accommodating a heating element wherein the element surface temperature reaches 800° to 1,000° Fahrenheit.

Another problem sometimes encountered in dishwashers is the accumulation of food particles in the bottom of the dishwasher. A desirable feature of any dishwasher bottom wall construction is that any food particles are swept into the pump for discharge by the pump into a drain after the dishwashing operation is complete.

SUMMARY OF THE INVENTION

Therefore a primary object of the present invention is the provision of an improved dishwasher tub bottom wall construction.

A further object of the present invention is the provision of an improved dishwasher bottom wall construction which provides a reduction in water usage per fill to approximately 7 quarts from the 11–12 quarts normally used in prior art dishwashers.

A further object of the present invention is the provision of an improved dishwasher bottom wall construction which provides a basin shape which will produce a maximum head of washing fluid for the pump with a reduced washing fluid volume.

A further object of the present invention is the provision of an improved dishwasher bottom wall construction which includes a sloped bottom wall to provide the quickest possible return of washing fluid by gravity drainage to the inlet of the pump for recirculation.

A further object of the present invention is the provision of an improved dishwasher bottom wall construction which includes a sloped bottom wall that ensures that food soils are washed into the pump without settling in other areas of the bottom wall away from the pump.

A further object of the present invention is the provision of an improved dishwasher bottom wall construction which provides adequate means for draining washing fluid away from the two front corners of the bottom wall.

A further object of the present invention is the provision of an improved dishwasher tub bottom wall construction which utilizes a plastic tub and which accommodates a heater capable of achieving surface temperatures from 800° to 1,000° Fahrenheit, while at the same time preventing the plastic from reaching temperatures above about 200° to 250°.

A further object of the present invention is the provision of an improved dishwasher tub bottom wall construction which is economical to manufacture, durable in use, and efficient in operation.

The foregoing objects are accomplished in the present invention by the provision of a dishwasher bottom wall which has a sump basin formed therein for containing a reservoir of washing fluid. The sump basin includes an upper rim extending around the perimeter thereof, the upper rim having a rear portion spaced inwardly from the rear edge of the bottom wall, opposite side portions spaced inwardly from the opposite side edges of the bottom wall, and a front portion spaced inwardly from the front edge of the bottom wall. The rim forms two spaced apart leg portions of the basin which extend forwardly into close proximity to the opposite corners of the front wall of the tub, thereby creating a horseshoe-like configuration for the sump basin.

A pump is mounted in the bottom wall within the sump basin and includes an inlet positioned to receive the washing fluid which is within the sump basin.

The bottom wall also includes front, rear, and opposite side margins sloping away from the upper rim of the sump basin and extending upwardly and outwardly to join the front wall, the rear wall, and the opposite sidewalls respectively of the tub. The result of this configuration is that the washing fluid which is sprayed from the spray arms within the tub will fall by gravity and will drain downwardly along the sloped margins of the bottom wall to the sump basin where the washing fluid will enter the pump and be recirculated for spraying on the dishes to be washed.

The two spaced apart leg portions of the sump basin which extend into the front corners of the bottom wall contain a standpipe for mounting a float mechanism operable for controlling the level of washing fluid introduced into the sump basin, and also contain an air conduit for introducing drying air flow into the tub after the dishes have been washed. The two spaced apart legs of the sump extend into the front corners of the tub and provide means for quickly draining the washing fluid from the front corners of the tub toward the pump so that food particles suspended in the washing fluid will be washed toward the pump rather than settling at various locations on the bottom wall. This washing action is also accomplished around the front, rear, and side margins of the bottom wall so that suspended particles are washed by the fluid into the sump and into the pump.

During the washing operation, the pump forces the washing fluid upwardly into rotating spray arms and other spray means so that the washing fluid will be sprayed onto the dishes to be washed. After the washing operation is complete, the pump is reversed, and draws the washing fluid out of the sump basin and expels it through a drain.

DETAILED DESCRIPTION OF THE PREFERRED EMBODIMENT

Figure 1:
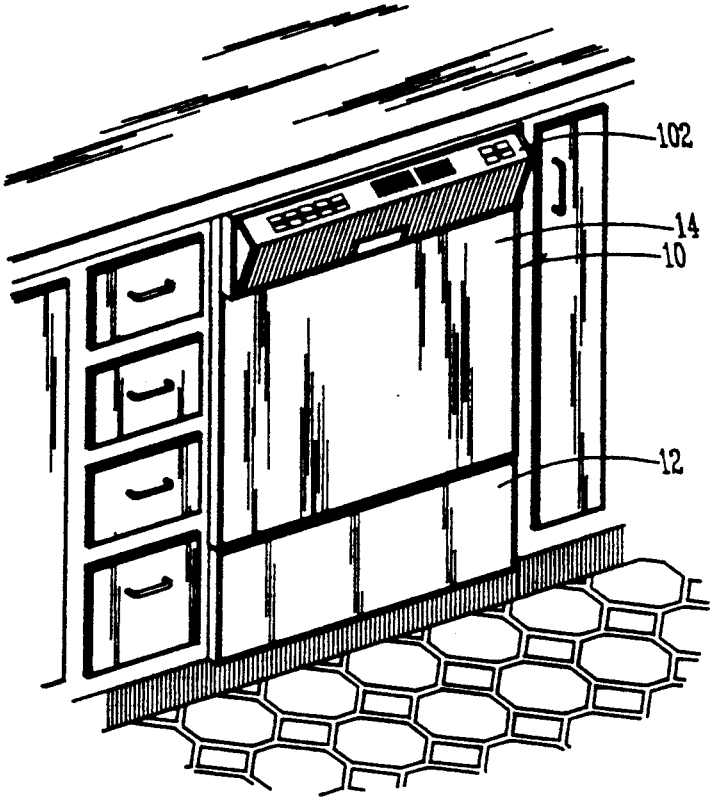
FIG. 1 is a perspective view of a dishwasher of the present invention having the front door closed.
Figure 2:
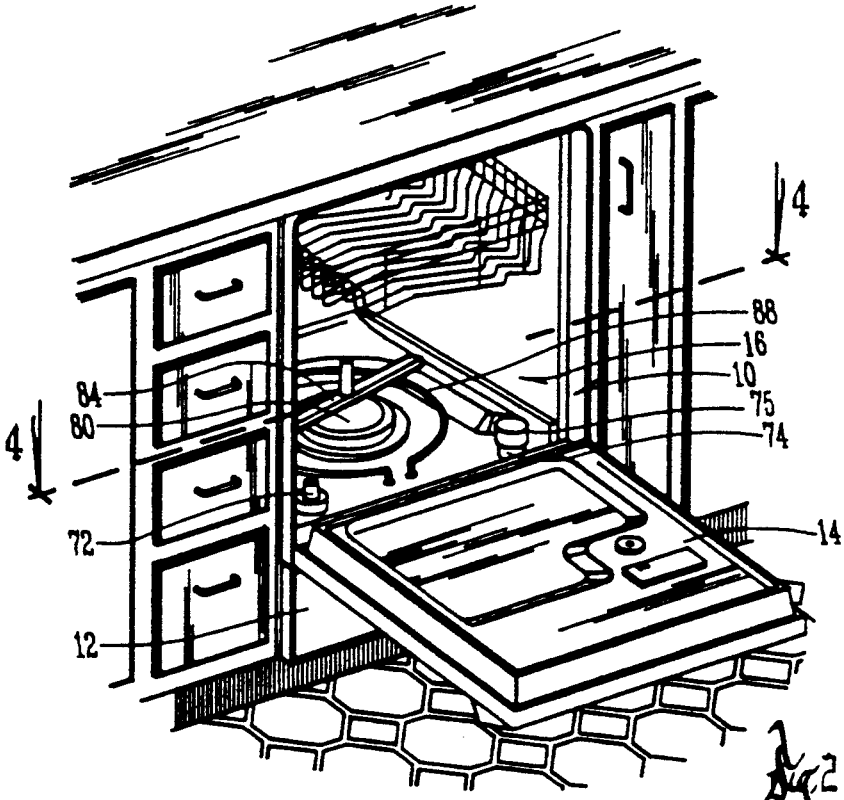
FIG. 2 is a perspective view of the installed dishwasher having the front door open.

Referring to the drawings, the numeral 10 generally designates the dishwasher of the present invention.

Dishwasher 10 includes a lower access panel and a front access door 14 which are provided on the front of a tub 16 (FIGS. 3 and 4) having a rear wall 18, opposite sidewalls 20, 22, a front wall 24, a bottom wall 26, and a top wall (not shown).

Bottom wall 26 includes a central opening having a plurality of slots 30 formed in a lower annular flange 32 which surrounds central opening 28. Lower annular flange 32 forms the lowest point of a sump basin 36, and is connected to a sloped annular shoulder 34 extending upwardly therefrom. Sump basin 36 includes a bottom wall portion 38 having arcuately curved sidewall portions 40 defining a bowl-like profile which terminate in an upper rim 42. Upper rim 42 is comprised of a semicircular rear rim portion 44 which extends forwardly to the front corners of the bottom wall and which forms a pair of spaced apart leg rim portions 46. The leg rim portions 46 are interconnected by a front rim portion 48 so as to complete the perimeter of the rim of the sump basin 36.

Figure 3:
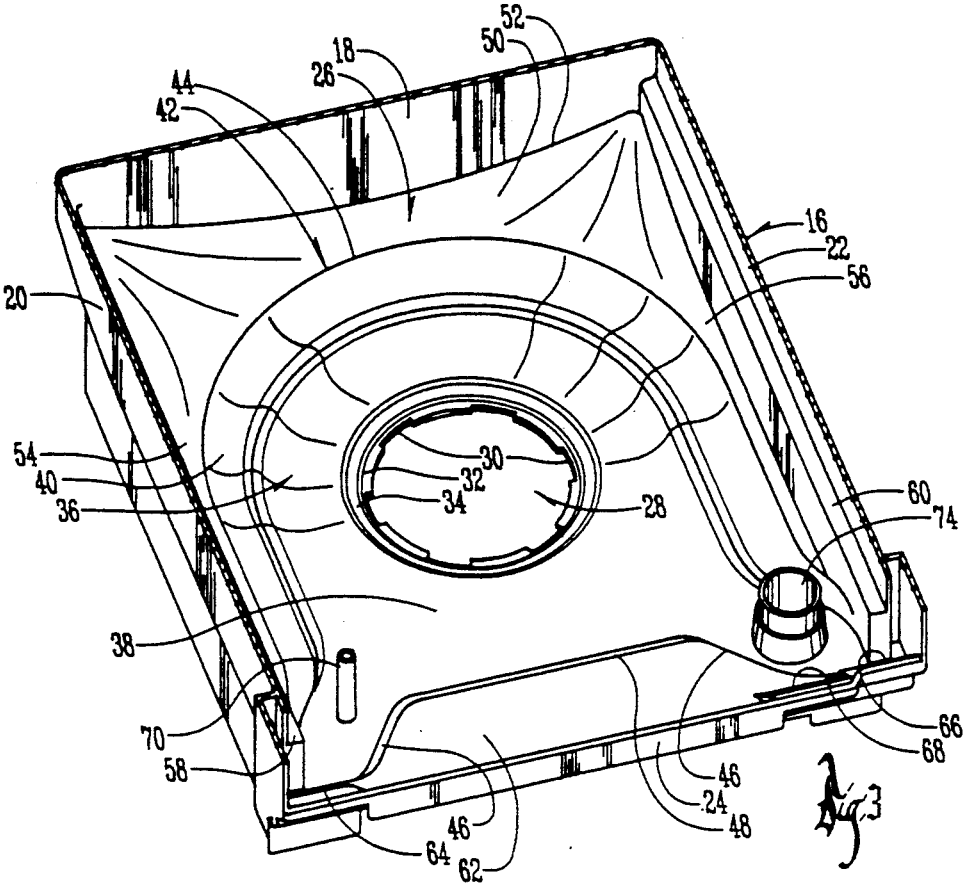
FIG. 3 is a cut away perspective detail of the tub bottom wall.
Figure 8:
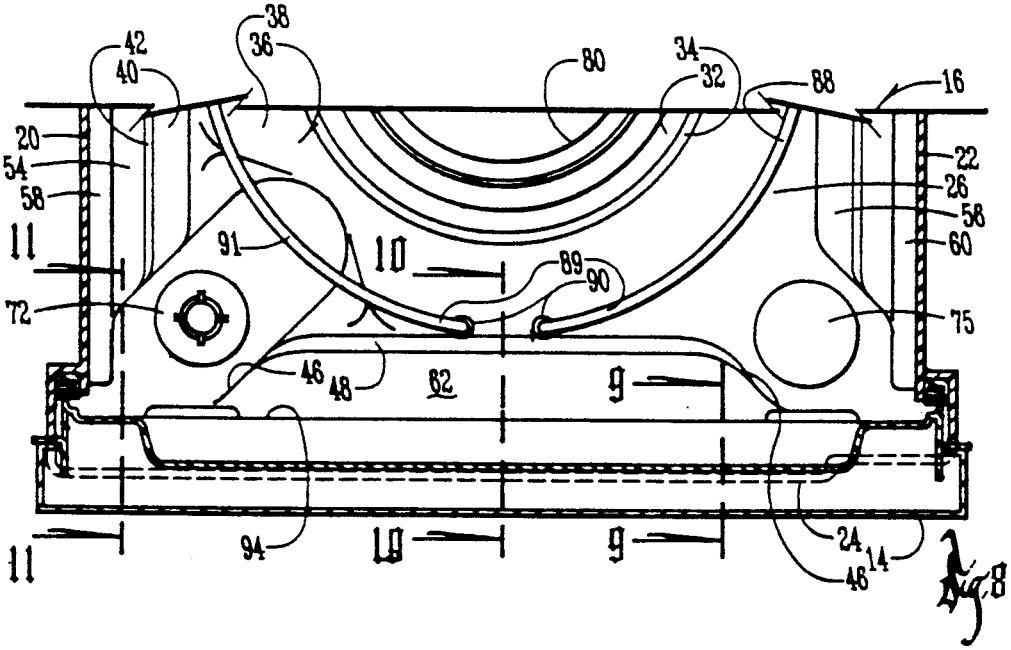
FIG. 8 is a partial view similar to FIG. 4, but showing the front door in place and closed.
Figure 4:
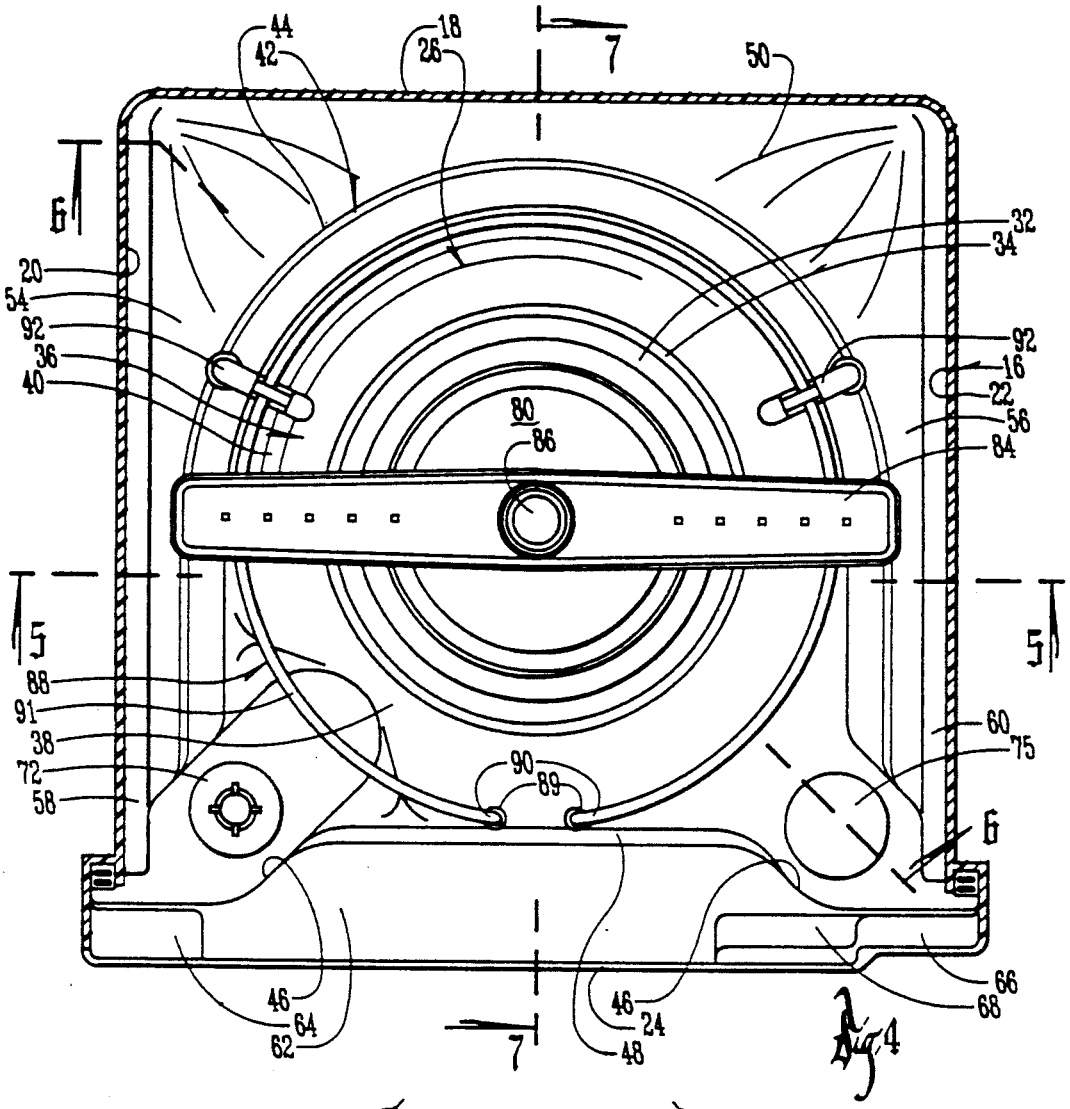
FIG. 4 is a sectional view taken along line 4—4 of FIG. 2, but showing the front door removed from the dishwasher.

Extending outwardly from the semicircular rear rim portion 44 is a rear sloping wall 50 which joins the rear wall 18 at a curved juncture line 52. Extending upwardly and outwardly from the sides of semicircular rear rim portion 44 are a pair of opposite side sloping walls 54, 56 which join the sidewalls 20, 22 respectively. Sidewalls 20, 22 include horizontal side ledges 58, 60 (FIGS. 3 and 4). Bottom wall 26 also includes a front sloping wall or margin 62 extending from the front rim portion 48 to the front wall 24. At the opposite ends of front wall 24 are a pair of corner ramps 64, 66, and adjacent the ramp 66 is an intermediate ramp 68. Ramps 64, 66 are located in close proximity to the door and prevent washing fluid from splashing out between the front corners of the bottom wall and the lower corners of the door 14. Ramp 66 and intermediate ramp 68 provide room for electrical wires 98 (FIG. 9) to enter the interior of door 14.

Within the left side leg rim portion 46 is an inlet pipe 70 (FIG. 3) which telescopically receives float 72 which operates a mechanical switch in circuit with an inlet valve (not shown) for permitting washing fluid to be introduced to the sump basin 36 and for controlling the level of washing fluid within the sump basin 36.

Figure 6:
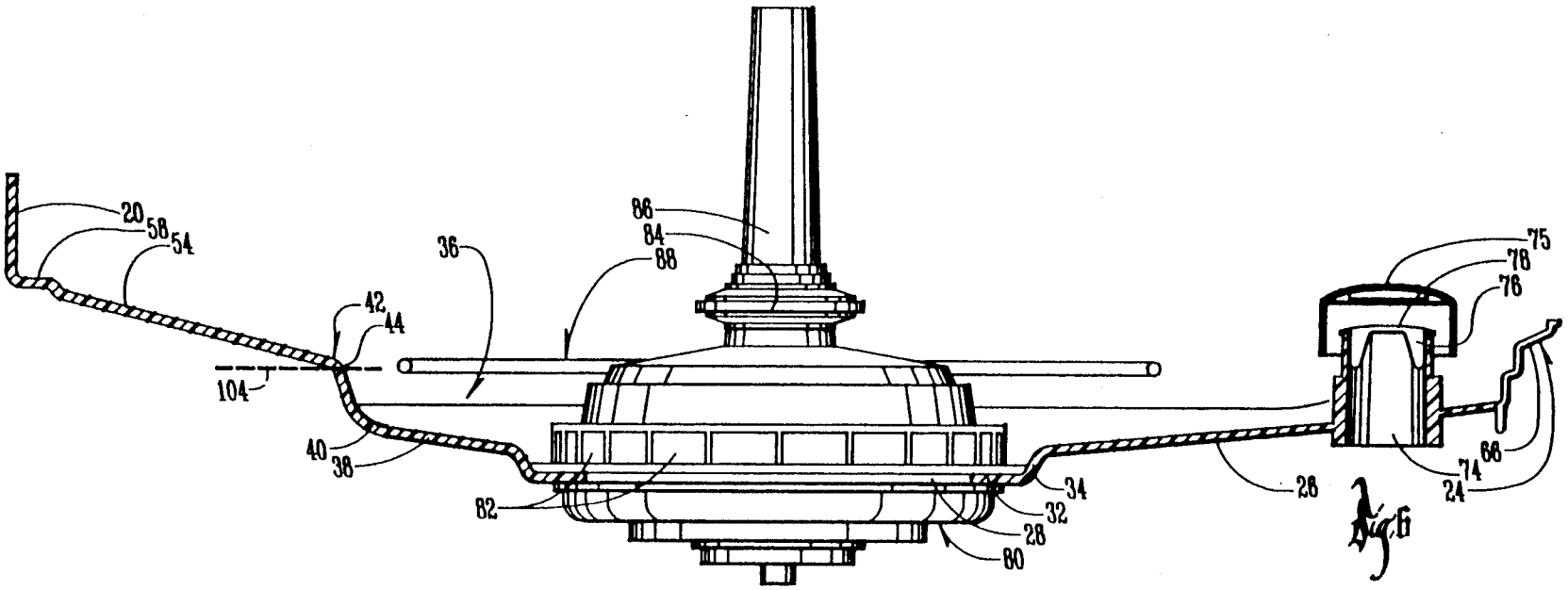
FIG. 6 is a sectional view taken along line 6—6 of FIG. 4.

Within the other leg portion 46 is an air inlet pipe 74 having a cover 75 and an air valve 76 (FIG. 6) associated therewith and a screen 78 thereover. The air inlet pipe 74 is connected to a blower (not shown) for blowing fresh air into the tub and over heater coil 88 after the dishes have been washed to facilitate the drying of the dishes.

Mounted within central opening 28 is a circular pump 80 having an annular pump inlet opening 82 extending around the circumference thereof. The pump 80 is sealed against the lower annular flange 32 so as to prevent washing fluid from exiting through opening 28, while at the same time positioning the annular pump inlet opening 82 adjacent the flange 32 so as to be located adjacent the lowest portion of the sump basin 36.

Pump 80 is connected to a lower wash arm 84 and an upstanding spray hub 86 for causing pressurized washing fluid to be delivered thereto for spraying on the dishes within the dishwasher 10.

Figure 5:
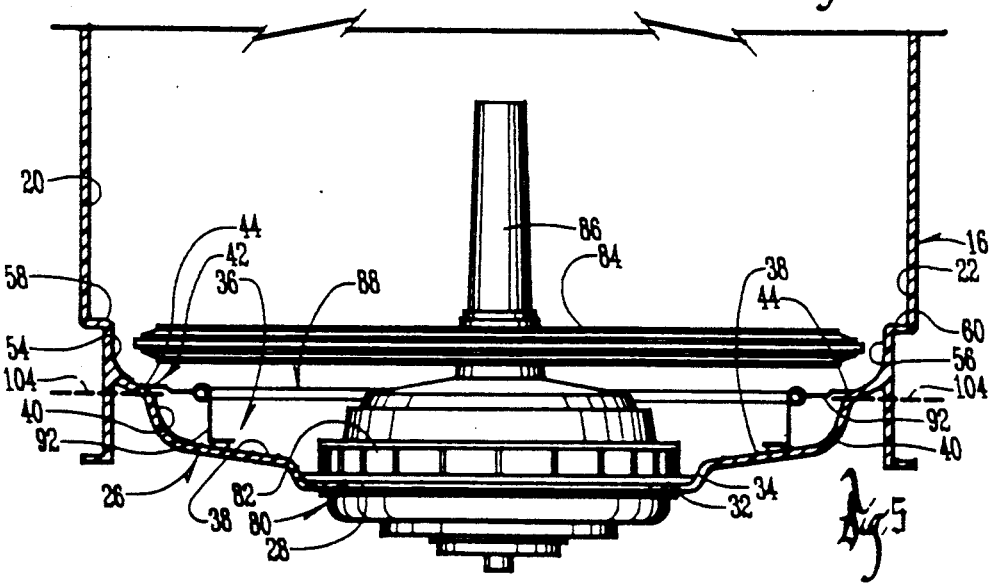
FIG. 5 is a sectional view taken along line 5—5 of FIG. 4.

A circular heater coil 88 includes terminal ends 89 which extend through the bottom wall 26 and through fittings 90 and gasket washers (not shown) seal the tub 16 from the heater coil 88 as the coil passes through the plastic of the bottom wall 26. Heater coil 88 also includes a main body portion 91 (FIG. 4) which is circular and which is positioned at approximately the same level as the upper rim 42 of sump basin 36. However, the main body portion 91 is spaced radially inwardly from the upper rim 42 as can be seen in FIGS. 4 and 5. This prevents the heater coil 88 from being too close to the plastic material of which the plastic tub is formed, thereby preventing the high temperatures of the heater coil from heating the plastic to a disfunctionally high temperature. Preferably the centerline of the heater coil 88 should be no closer than 1¼ inches from the plastic of bottom wall 26. A pair of insulated holding brackets 92 hold the main body portion 91 of heating coil 88 in the position shown in FIGS. 4 and 5.

The tub 16 is molded from a plastic material which may be made from any number of selected plastics. An example of a preferred plastic is a polypropylene material manufactured by Exxon under the designation MDK312. This is a plastic material which is 20 percent talc filled. This material will withstand temperatures of at least 200° to 250° Fahrenheit without deforming or otherwise malfunctioning as a material for use in the dishwasher tub.

The heater coil 88 is adapted to heat to a maximum coil surface temperature of 800° to 1,000° Fahrenheit. By keeping the centerline of the heater coil 88 a minimum of 1¼ inches away from the plastic within the tub 16, the temperature of the plastic can be maintained below 200° to 250°. As an added precaution, a thermostat (not shown) may be mounted on the undersurface of the bottom wall 26 for sensing the temperature of the plastic, and should preferably be set at approximately 155° Fahrenheit so that it shuts off the heater coil 88 whenever the temperature at the bottom surface of the bottom wall 26 exceeds 155°.

Figure 7:
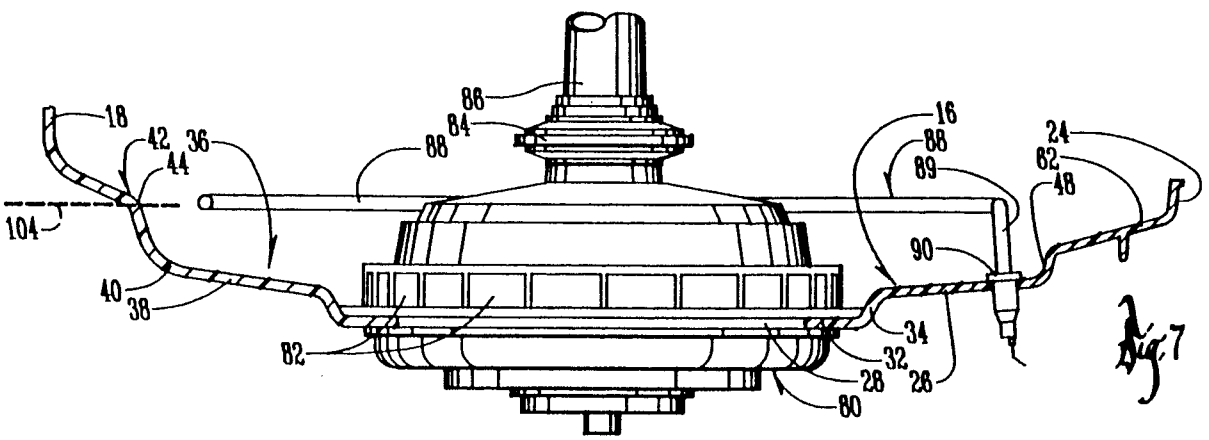
FIG. 7 is a sectional view taken along line 7—7 of FIG. 4.

The sump basin 36 has a substantially reduced volume over that encountered in many prior art dishwashers. The numeral 104 (FIG. 7) indicates the preferred washing fluid level in sump basin 36 before the pump 80 begins operation. The level 104 coincides approximately with the upper rim 42 of sump basin 36. In one example of a dishwashing machine made with the present invention, the bottom wall 26 had a total area of approximately 455 square inches as viewed in a plan view, and the area of the sump basin 36, including the area occupied by the pump 80 was approximately 263 square inches, or approximately 58 percent of the total area of the bottom wall 26. A sump basin 36 constructed according to these dimensions will support non-starving operation of pump 80 by providing maximum head with a reduced washing fluid volume of approximately 7.0 quarts of washing fluid by increasing the rate of washing fluid return to the pump 80 through the steeply sloping curved sidewall portions. This is contrasted with 11 or 12 quarts of washing fluid commonly used in prior devices not having the unique sump basin configuration of the present invention. This results in conservation of water, and also conservation of energy required to heat the water by permitting heater coil 88 to be of reduced wattage.

All portions of the bottom wall 26 slope in a direction towards the center of the bottom wall 26 where the pump 80 is located. The slopes of rear sloping wall 50, the side sloping walls 54, 56, and the front sloping wall 62 are particularly steep so as to cause washing fluid to drain quickly and easily toward the sump basin 36. The bottom wall portion 38 of the sump basin 36 also slopes toward the annular inlet opening 82 of the pump 80 so that food particles and washing fluid will be washed by gravity toward the inlet opening 82 of the pump 80. An important feature of the present invention is the provision of the spaced apart leg portions 46 of the sump basin 36 which are sloped toward the center of the bottom wall 38, and which provide sufficient washing fluid depth at the two opposite front corners of the tub bottom wall 26 so as to permit full drainage of the washing fluid away from the front corners of the tub 16 toward the pump 80. Sufficient space is provided in the front leg portions 46 so as to permit food particles to pass around fluid level control float 72 and air inlet pipe 74.

Figure 9:
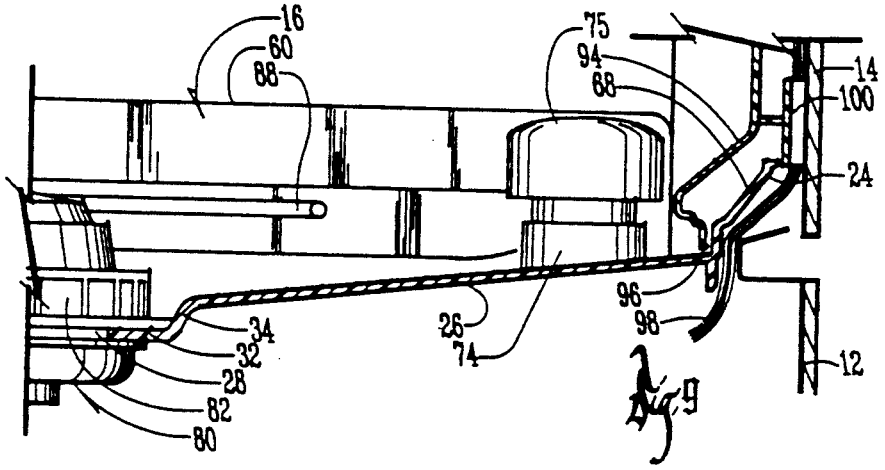
FIG. 9 is a sectional view taken along line 9—9 of FIG. 8.
Figure 10:
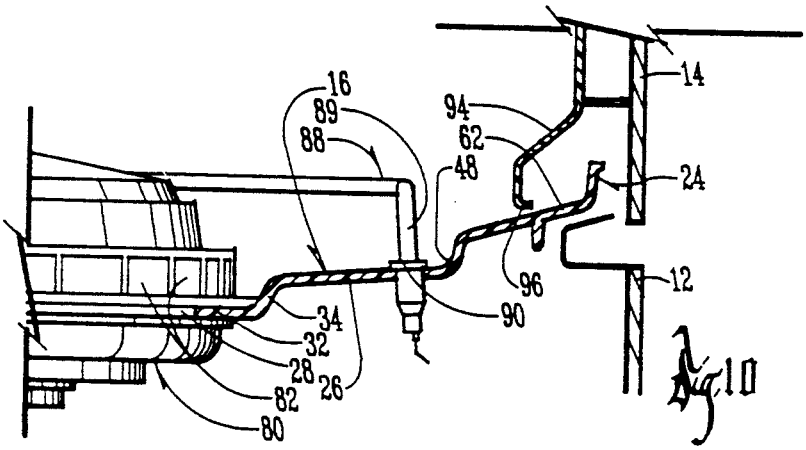
FIG. 10 is a sectional view taken along line 10—10 of FIG. 8.
Figure 11:
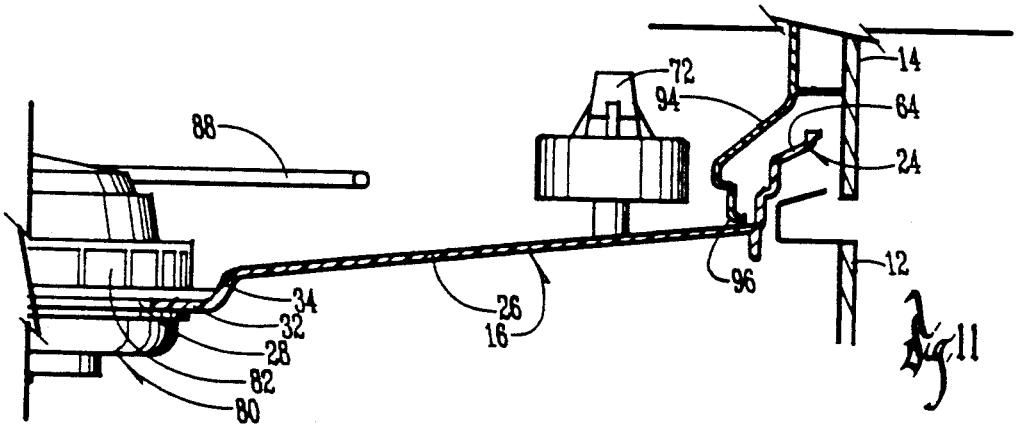
FIG. 11 is a sectional view taken along line 11—11 of FIG. 8.

Referring to FIGS. 9, 10, and 11, the front door 14 includes a downwardly extending water deflecting flange 94 which fits in front of front wall 24. The lower tip 96 of flange 94 is adapted to be spaced approximately 5/32 of an inch from the bottom wall 26 when the door 14 is closed as shown in FIGS. 10. FIG. 9 illustrates the manner in which flange 94 covers intermediate ramp 68. The purpose of intermediate ramp 68 is to provide a space for electrical wires 98 to extend from below the tub 16 upwardly through a wire retainer 100 into the interior of door 14 so that the wires 98 can gain access to the control panel 102 (FIG. 1). FIG. 10 shows the manner in which the flange 94 protects against washing fluid leaking outwardly over the front wall 24. FIG. 11 illustrates the manner in which flange 94 covers corner ramp 64 to prevent leakage at the front corners of bottom wall 26. A similar construction is used at the juncture between door flange 94 and corner ramp 66.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. An improvement in a dishwasher having a tub comprising a bottom wall, a top wall, a front wall, a rear wall, and two sidewalls, said front wall having a door opening therein, a door being hinged to said tub for hinged movement from a closed position in covering relation over said front opening of said tub to an open position providing access to the interior of said tub through said front opening, pump means mounted to said bottom wall and having an inlet for taking washing fluid into said pump means, and spray means connected to said pump means for receiving washing fluid therefrom and for spraying said washing fluid into said tub to effect the washing of dishes within said tub, said bottom wall comprising a front edge, a rear edge, and two opposite side edges, said improvement comprising:

said bottom wall being formed into a sump basin having an upper rim extending around the perimeter thereof, said upper rim having a rear portion spaced inwardly from said rear edge of said bottom wall, opposite side portions spaced inwardly from said opposite side edges of said bottom wall, and a front portion spaced inwardly from said front edge of said bottom wall;

said upper rim of said sump basin forming two spaced apart leg portions of said basin, said leg portions extending forwardly into close proximity to said front wall of said tub;

said pump means being mounted to said bottom wall within said sump basin with said inlet of said pump means positioned to communicate with washing fluid within said sump basin;

said bottom wall having front, rear, and opposite side margins sloping from said upper rim upwardly and outwardly to join said front wall, said rear wall, and said opposite sidewalls respectively whereby washing fluid sprayed from said spray means will drain by gravity down said sloping front, rear, and opposite side margins of said bottom wall into said sump basin.

2. An improvement according to claim 1 wherein a washing fluid inlet control means is mounted within one of said leg portions of said sump basin, said inlet control means being capable of controlling the level of said washing fluid within said sump basin.

3. An improvement according to claim 2 wherein a blower inlet conduit is provided in said bottom wall within the other of said leg portions of said sump basin, said blower inlet conduit being capable of introducing air into said tub for drying said dishes after said dishes have been washed.

4. An improvement according to claim 1 wherein all of said front, rear, and opposite side margins of said bottom wall slope from said front wall, said rear wall, and said opposite side walls respectively toward said pump means.

5. An improvement according to claim 4 wherein said sump basin includes a basin wall below said basin rim, said basin wall sloping from all parts of said rim of said basin toward said pump means so as to cause said washing fluid to drain toward said pump means.

6. An improvement according to claim 1 wherein said sump basin as viewed from a plan view, occupies a reduced area from the total area of said bottom wall as viewed from a plan view.

7. An improvement according to claim 6 wherein the ratio of said reduced area, including the area occupied by said pump, to said total area of said bottom wall is less than 60%.

8. An improvement according to claim 6 wherein the volume of said sump basin below said rim is approximately 7 quarts.

9. An improvement according to claim 1 wherein said spray means comprises a horizontal elongated lower spray arm mounted to said pump means above said rim of said sump basin for rotation about a vertical axis, a heater coil being mounted within said tub below said lower spray arm, and including a curved portion within said tub and terminal ends extending through said bottom wall of said tub to the exterior thereof, said curved portion being at the approximate level of said rim and being spaced from and free from contact with said bottom wall, said tub being comprised of plastic material.

10. An improvement according to claim 1 wherein said bottom wall is approximately rectangular in plan view and includes a pair of spaced apart front corners adjacent said front wall of said tub, each of said spaced apart leg portions of said sump basin extending into one of said front corners of said bottom wall.

11. An improvement according to claim 10 wherein said opposite side portions of said rim commence at said leg portions of said sump basin and extend rearwardly therefrom to connect with said rear portion of said rim in a continuous arcuate shape, said front portion extending between said spaced apart leg portions, whereby said rim forms a horseshoe-like shape.

12. An improvement according to claim 1 wherein said bottom wall includes an opening therein within said sump basin, said opening having annular edges, said pump means being mounted within said opening, sealing means providing a seal between said pump and said annular edges of said opening.

13. An improvement according to claim 12 wherein said inlet of said pump means comprises an annular inlet opening extending around said pump means closely adjacent said annular edges of said opening in said bottom wall.

14. An improvement according to claim 13 wherein said bottom wall includes an annular depression surrounding said pump adjacent said annular inlet opening of said pump, said annular depression being lower than all other portions of said bottom wall.

15. An improvement in a bottom wall configuration of a dishwasher tub comprising a bottom wall, a top wall, a rear wall, two side walls, and an open front, pump means mounted to said bottom wall and having an inlet for taking in washing fluid for recirculation within said tub to effect the washing of dishes arranged therein, said bottom wall including a front edge, a rear edge, and two opposite side edges, said improvement comprising:

said bottom wall being formed into a sump basin including an upper rim extending around a portion of the inner perimeter of said tub bounded by said rear wall and said side walls, in plan view said upper rim having a semicircular rear portion spaced inwardly from said rear edge of said bottom wall, and opposite side portions spaced inwardly from and generally parallel to said opposite side edges of said bottom wall;

said sump basin further including a substantially horizontally disposed pump mounting surface for mounting said pump means in a posture to communicate with washing fluid within said sump basin;

said sump basin still further including rear and opposite side margins sloping from said upper rim upwardly and outwardly to join said rear wall and said opposite side walls respectively;

said sump basin yet further including lower wall portions extending from said upper rim downwardly and inwardly along an arcuately curved path for defining a bowl-like profile between said upper rim and said pump mounting surface.

16. An improvement according to claim 15 wherein said upper rim further includes a front portion spaced inwardly from said front edge of said bottom wall.

17. An improvement according to claim 16 wherein said upper rim of said sump basin forms two spaced-apart leg portions of said sump basin, said leg portions extending forwardly into close proximity to said front wall of said tub.

18. An improvement according to claim 17 wherein said spaced-apart leg portions slope toward said pump means to facilitate drainage of washing fluid from the front corners of said tub bottom.

* * * * *